US007597493B2

(12) United States Patent
Mori et al.

(10) Patent No.: US 7,597,493 B2
(45) Date of Patent: Oct. 6, 2009

(54) TAPE PRINTING DEVICE AND PROGRAM

(75) Inventors: Masaharu Mori, Anjo (JP); Jun Itakura, Nagoya (JP); Satoru Moriyama, Iwakura (JP); Takeo Ito, Nagoya (JP)

(73) Assignee: Brother Kogyo Kabsuhiki Kaisha, Nagoya (JP)

( * ) Notice: Subject to any disclaimer, the term of this patent is extended or adjusted under 35 U.S.C. 154(b) by 345 days.

(21) Appl. No.: 10/548,546

(22) PCT Filed: Mar. 25, 2004

(86) PCT No.: PCT/JP2004/004237

§ 371 (c)(1),
(2), (4) Date: Sep. 13, 2005

(87) PCT Pub. No.: WO2004/087427

PCT Pub. Date: Oct. 14, 2004

(65) Prior Publication Data

US 2006/0159508 A1 Jul. 20, 2006

(30) Foreign Application Priority Data

Mar. 31, 2003 (JP) ..... 2003-093040

(51) Int. Cl.
*B41J 11/66* (2006.01)
*B41J 29/38* (2006.01)

(52) U.S. Cl. ..... 400/621; 400/76

(58) Field of Classification Search ..... 156/517, 156/531; 700/117, 118; 400/61, 70, 83, 400/88, 615.2, 62, 621; *B41J 15/00, 11/44, B41J 5/30*

See application file for complete search history.

(56) References Cited

U.S. PATENT DOCUMENTS

| | | | | |
|---|---|---|---|---|
| 4,572,686 | A * | 2/1986 | Tanaka | 400/621.1 |
| 4,598,780 | A | 7/1986 | Iwasaki et al. | 177/3 |
| 4,700,791 | A | 10/1987 | Iwasaki et al. | 177/2 |
| 4,717,059 | A | 1/1988 | Takahashi | 226/2 |
| 5,222,818 | A | 6/1993 | Akiyama et al. | 400/613 |
| 5,409,317 | A | 4/1995 | Ueno et al. | 400/61 |
| 5,492,420 | A * | 2/1996 | Nunokawa et al. | 400/62 |
| 5,503,483 | A * | 4/1996 | Petteruti et al. | 400/88 |
| 5,823,694 | A * | 10/1998 | Ikegami | 400/621 |

(Continued)

FOREIGN PATENT DOCUMENTS

EP 0 473 147 A2 3/1992

(Continued)

*Primary Examiner*—Daniel J Colilla
(74) *Attorney, Agent, or Firm*—Oliff & Berridge, PLC

(57) ABSTRACT

There is provided a tape printing device capable of using long tape-like print media such as label tape having a plurality of label areas as targets of printing arranged on a long support tape along the length of the support tape and normal tape allowing printing at any position on a long tape-like image receiving medium, comprising judgment means for judging whether the print medium currently used is label tape or normal tape and feed cut control means for performing a feed cut operation of feeding the print medium and thereafter cutting the print medium. The feed cut control means includes feeding distance control means for controlling feeding distance before the cutting in the feed cut operation depending on the judgment by the judgment means.

21 Claims, 7 Drawing Sheets

U.S. PATENT DOCUMENTS

| | | | |
|---|---|---|---|
| 2002/0006303 | A1 | 1/2002 | Yamaguchi et al. |
| 2002/0164185 | A1 | 11/2002 | Horiuchi et al. |

FOREIGN PATENT DOCUMENTS

| | | | | |
|---|---|---|---|---|
| EP | 0 473 147 | A3 | | 3/1992 |
| EP | 1 223 043 | A1 | | 7/2002 |
| JP | A-59-156773 | | | 9/1984 |
| JP | A-60-184869 | | | 9/1985 |
| JP | A-01-163073 | | | 6/1989 |
| JP | A-05-084995 | | | 4/1993 |
| JP | A-06-040116 | | | 2/1994 |
| JP | 06293146 | A | * | 10/1994 |
| JP | A-07-125350 | | | 5/1995 |
| JP | A-07-228015 | | | 8/1995 |
| JP | A-07-251539 | | | 10/1995 |
| JP | A-07-276724 | | | 10/1995 |
| JP | A-10-230649 | | | 9/1998 |
| JP | 11254866 | A | * | 9/1999 |
| JP | A-11-254866 | | | 9/1999 |
| JP | 2002166605 | A | * | 6/2002 |

* cited by examiner

TAPE PRINTING DEVICE AND PROGRAM

TECHNICAL FIELD

The present invention relates to a printing device capable of printing data (as the object of printing) on a long tape-like print medium.

BACKGROUND OF THE INVENTION

Tape printing devices capable of printing a desired character string on the surface of a print sheet of print tape (including a strippable sheet and the print sheet having an adhesive layer previously formed on its back which are stacked up to be strippable) are widely known. Such a tape printing device has been disclosed in Japanese Patent Provisional Publication No. HEI01-163073. Tape printing devices of this type provide high usability to users since a title, caption, etc. can be printed on the tape surface quickly and beautifully and the print sheet which has been printed on can be stuck on the spine of a file, videotape, etc. Due to such high usability, tape printing devices are widely used for office use, home use, etc.

Print tapes used for such tape printing devices are available in various widths and types (normal print tape, label tape, etc.). The label tape is formed of a strippable sheet and an adhesive print sheet (having an adhesive layer formed on its back) which are stacked up to be strippable. On the print sheet, dividing lines, for dividing label areas as the targets of printing (parts to become labels) from other peripheral areas, are formed previously.

When normal print tape is used, the print tape has to be fed a preset distance after the printing in order to cut off part of the print tape that has been printed on, since a tape cutter is apart from a printing head. Therefore, tape printing devices are generally configured to feed the print tape a preset distance when a prescribed key of the device is manipulated.

Meanwhile, when label tape is used, the printing has to be executed only on the label areas of the label tape. Therefore, the label tape after the printing on a label area is automatically fed until the front end of the next label area faces the printing head. In this state after the automatic tape feeding, if the user manipulates the prescribed key and the print tape is fed a preset distance, the printing head does not face the front end of the label area any more, resulting in wastage of labels in the printing. To avoid the problem, the tape printing device of the aforementioned patent document is configured not to execute the tape feeding for the preset distance when label tape is used, even if the prescribed key is manipulated.

DISCLOSURE OF THE INVENTION

However, if a tape printing device is configured as above not to execute the tape feeding for the preset distance when label tape is used, the user has to change the way of operating the tape printing device depending on whether the print tape used is normal print tape or label tape and such usage of the device is confusing to the user.

It is therefore the primary object of the present invention to provide a tape printing device, a printing operation control method and a program that cause no confusion to the user even when label tape is used.

In accordance with an aspect of the present invention, there is provided a tape printing device capable of using long tape-like print media such as label tape having a plurality of label areas as targets of printing arranged on a long support tape along the length of the support tape and normal tape allowing printing at any position on a long tape-like image receiving medium, comprising judgment means for judging whether the print medium currently used is label tape or normal tape and feed cut control means for performing a feed cut operation of feeding the print medium and thereafter cutting the print medium. The feed cut control means includes feeding distance control means for controlling feeding distance before the cutting in the feed cut operation depending on the judgment by the judgment means.

By the above configuration, even when label tape is used, the user can make the tape printing device execute the feed cut operation by performing the same operation as that for normal tapes. Therefore, the tape printing device configured as above causes no confusion to the user.

In accordance with another aspect of the present invention, there is provided a tape printing device capable of using long tape-like print media such as label tape having a plurality of label areas as targets of printing arranged on a long support tape along the length of the support tape and normal tape allowing printing at any position on a long tape-like image receiving medium, comprising judgment means for judging whether the print medium currently used is label tape or normal tape and feed control means for performing a feed operation of feeding the print medium. The feed control means includes feeding distance control means for controlling feeding distance in the feed operation depending on the judgment by the judgment means.

By the above configuration, the user, even when using label tape, can make the tape printing device execute the feed operation by performing the same operation as that for normal tapes. Therefore, the tape printing device configured as above causes no confusion to the user.

In accordance with another aspect of the present invention, there is provided a program which lets a tape printing device (capable of using long tape-like print media such as label tape having a plurality of label areas as targets of printing arranged on a long support tape along the length of the support tape and normal tape allowing printing at any position on a long tape-like image receiving medium) function as judgment means for judging whether the print medium currently used is label tape or normal tape and feed cut control means for performing a feed cut operation of feeding the print medium and thereafter cutting the print medium. The feed cut control means includes feeding distance control means for controlling feeding distance before the cutting in the feed cut operation depending on the judgment by the judgment means.

By the above configuration, the user, even when using label tape, can make the tape printing device execute the feed operation by performing the same operation as that for normal tapes. Therefore, the configuration causes no confusion to the user.

In accordance with another aspect of the present invention, there is provided a program which lets a tape printing device (capable of using long tape-like print media such as label tape having a plurality of label areas as targets of printing arranged on a long support tape along the length of the support tape and normal tape allowing printing at any position on a long tape-like image receiving medium) function as judgment means for judging whether the print medium currently used is label tape or normal tape and feed control means for performing a feed operation of feeding the print medium. The feed control means includes feeding distance control means for controlling feeding distance in the feed operation depending on the judgment by the judgment means.

By the above configuration, the user, even when using label tape, can make the tape printing device execute the feed operation by performing the same operation as that for normal tapes. Therefore, the configuration causes no confusion to the user.

In accordance with another aspect of the present invention, there is provided a tape printing device capable of using long tape-like print media such as label tape having a plurality of label areas as targets of printing arranged on a long support tape along the length of the support tape and normal tape allowing printing at any position on a long tape-like image receiving medium, comprising judgment means for judging whether the print medium currently used is label tape or normal tape and control means for executing control so as to perform a feed operation to the print medium differently depending on the judgment by the judgment means.

By the above configuration, the user, even when using label tape, can make the tape printing device execute the feed operation by performing the same operation as that for normal tapes. Therefore, the tape printing device configured as above causes no confusion to the user.

In accordance with another aspect of the present invention, there is provided a printing operation control method for a tape printing device capable of using long tape-like print media such as label tape having a plurality of label areas as targets of printing arranged on a long support tape along the length of the support tape and normal tape allowing printing at any position on a long tape-like image receiving medium, comprising the steps of: judging whether the print medium currently used is label tape or normal tape; and controlling feeding distance before cutting in a feed cut operation of feeding the print medium and thereafter cutting the print medium, depending on the judgment by the judging step.

By the above configuration, the user, even when using label tape, can make the tape printing device execute the feed operation by performing the same operation as that for normal tapes. Therefore, the configuration causes no confusion to the user.

In accordance with another aspect of the present invention, there is provided a printing operation control method for a tape printing device capable of using long tape-like print media such as label tape having a plurality of label areas as targets of printing arranged on a long support tape along the length of the support tape and normal tape allowing printing at any position on a long tape-like image receiving medium, comprising the steps of: judging whether the print medium currently used is label tape or normal tape; and controlling feeding distance in a feed operation of feeding the print medium, depending on the judgment by the judging step.

By the above configuration, the user, even when using label tape, can make the tape printing device execute the feed operation by performing the same operation as that for normal tapes. Therefore, the configuration causes no confusion to the user.

BEST MODE FOR CARRYING OUT THE INVENTION

Figure 1:
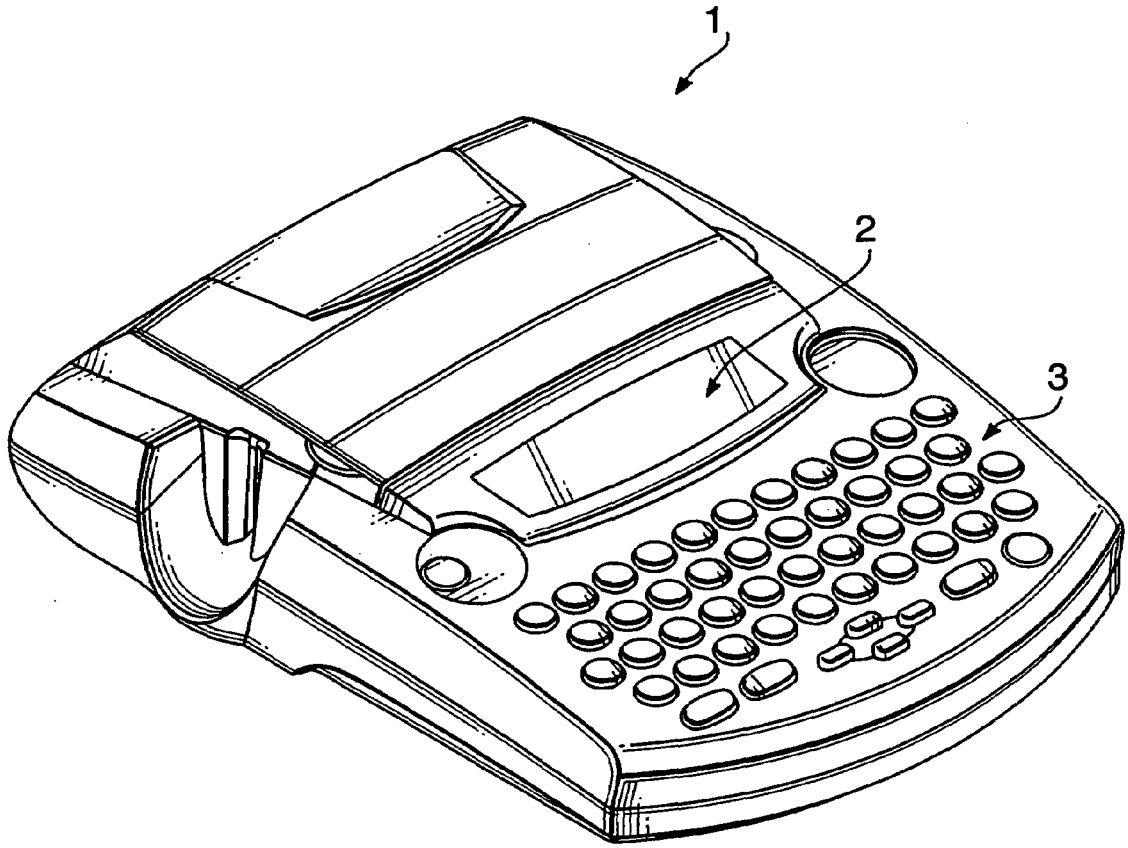
FIG. 1 is an external view of a tape printing device in accordance with an embodiment of the present invention.

Referring now to the drawings, a description will be given in detail of a preferred embodiment in accordance with the present invention. FIG. 1 is an external view of a tape printing device 1 in accordance with an embodiment of the present invention. As shown in FIG. 1, the tape printing device 1 has a display 2 and a keyboard 3 which are arranged in a front part of its top surface. The rear part of the tape printing device 1 is provided with a cover which is openable and closable. Inside the cover, a cassette storage part 7 (see FIG. 4) provided with a printing head 4 (see FIG. 3) is placed.

Print tape 10, as a print medium for the tape printing device 1, is formed of a print sheet as a long tape-like print medium (having a print surface (on which characters, symbols, etc. will be printed) on its front and an adhesive material layer on its back) and a strippable sheet (having a releasable surface processed with silicone resin, etc.) which are stacked up to be strippable. The print tape 10 is rolled up and stored in a tape cassette 8. The tape cassette 8 is detachably loaded in the cassette storage part 7 of the tape printing device 1. Inside the tape printing device 1, the print tape 10 is pulled out from the tape cassette 8, printed on, and cut to a proper length. By stripping the strippable sheet away from the print sheet of the print tape 10 which has been cut off, the user can use the print sheet as a label which can be stuck on an arbitrary object, article, etc.

Figure 2:
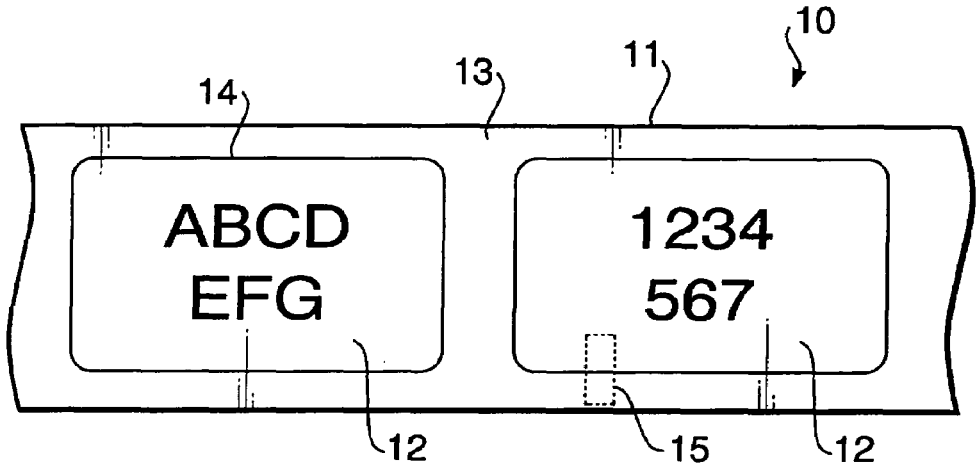
FIG. 2 is an external view seeing a print surface of label tape which can be printed on by the tape printing device of FIG. 1.

Next, label tape 11, as a type of print tape 10 used for the tape printing device 1, will be explained referring to FIG. 2. FIG. 2 is an external view seeing the label tape 11 from its print surface. The label tape 11 is formed of a print sheet (having the print surface on its front and an adhesive material layer on its back) and a strippable sheet (having a releasable surface) which are stacked up to be strippable. The print sheet has a plurality of label areas 12 having a prescribed planar shape (e.g. rectangle with rounded four corners) and a peripheral area 13. The label areas 12 have already been divided from the peripheral area 13 by cut lines 14 to be separable.

The user can use each label area 12 as a label by stripping it away from the strippable sheet and sticking it on a desired object. On the back of the label tape (strippable sheet), a position indication mark 15 is provided in the vicinity of an edge of each label area 12.

The position indication mark 15 is detected by a position detection sensor 72 (see FIG. 4, explained later) in order to adjust the position of the printing head 4 (explained later) in the label area 12. Incidentally, the shape of the label area 12 is not limited to rectangular shapes but can be various shapes (circle, etc.). Ordinary print tapes 10 other than such label tapes 11 are called "normal tapes".

Figure 3:
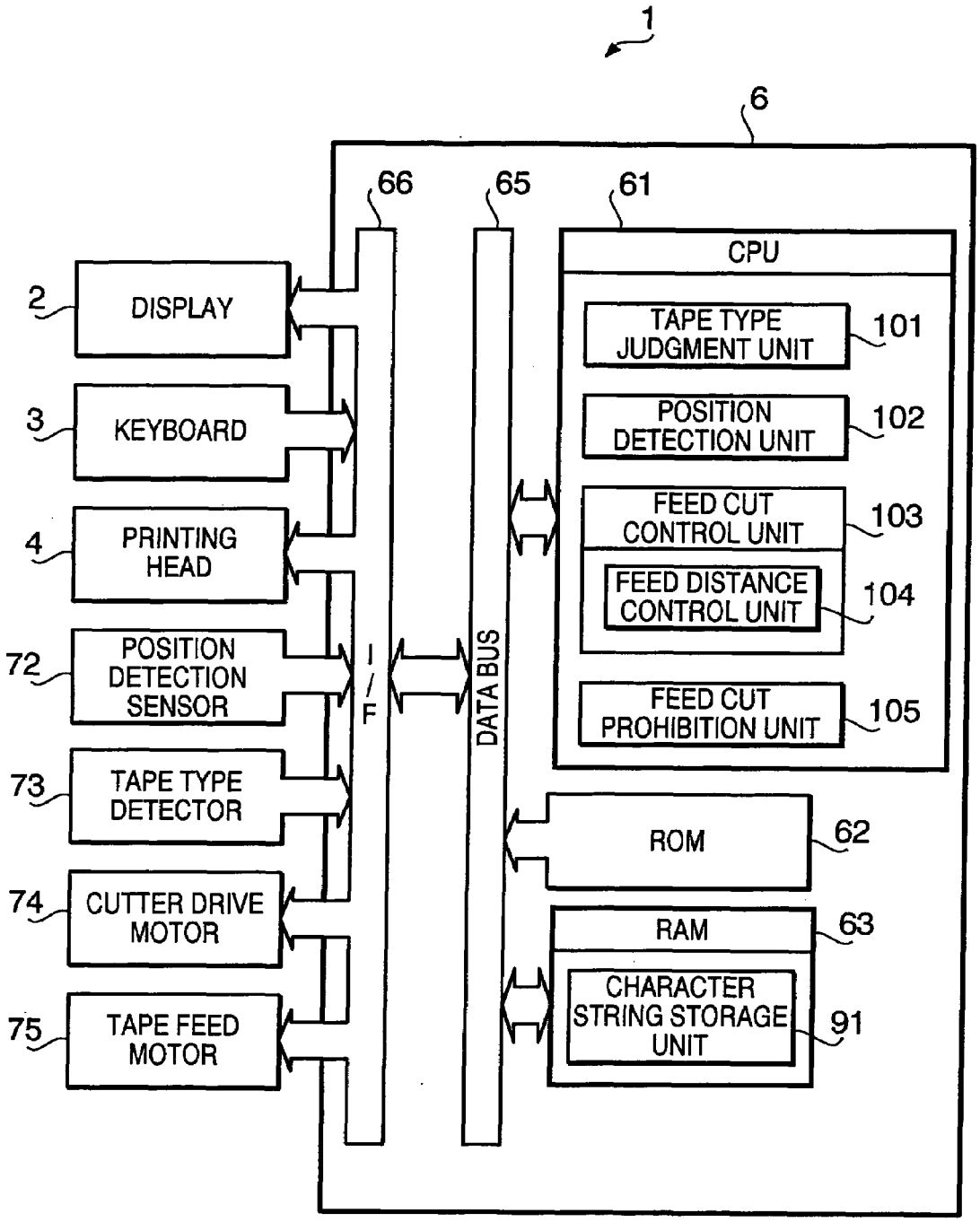
FIG. 3 is a block diagram showing the internal composition of the tape printing device of FIG. 1.

Next, the composition of the tape printing device 1 will be described referring to FIG. 3. FIG. 3 is a block diagram showing the composition of the tape printing device 1. The tape printing device 1 includes the display 2, the keyboard 3, the printing head 4, the position detection sensor 72, a tape type detector 73, a cutter drive motor 74, a tape feed motor 75, a control unit 6, and the cassette storage part 7 (unshown). The display 2 is implemented by a well-known liquid crystal display.

The keyboard 3 on the top surface of the tape printing device 1 includes text keys and a decision key used for inputting characters to be printed, cursor keys used for moving a cursor, function keys (print key, feed & cut key, etc.) used for calling up various functions of the tape printing device 1, etc.

The printing head 4 is placed inside the cassette storage part 7 at a position corresponding to a tape exposing part formed on a lateral face of the tape cassette 8. The printing head 4 has a number of heating elements which are electrically controlled by the control unit 6. The heating elements are arranged in a width direction of the print tape 10 (i.e. in a direction orthogonal to a lengthwise direction of the print tape).

The position detection sensor 72 is a sensor for detecting the position indication marks of the label tape 11. The position detection sensor 72 is placed inside the cassette storage part 7 at a position corresponding to the tape exposing part formed on the lateral face of the tape cassette 8.

The tape type detector 73 is a unit for judging the type of the print tape 10 contained in the tape cassette 8 loaded in the cassette storage part 7. The tape type detector 73 is placed at a position to face the base of the tape cassette 8 loaded in the cassette storage part 7.

The cutter drive motor 74 is a motor for driving a tape cutter 71 (see FIG. 4) for cutting the print tape 10. The tape feed motor 75 is a motor for driving a feed roller 87 (see FIG. 4) for feeding the print tape 10.

The control unit 6 includes a CPU (Central Processing Unit) 61, a ROM (Read Only Memory) 62, a RAM (Random Access Memory) 63, a data bus 65 and an interface unit 66. The CPU 61 is a central processing unit executing calculations according to various commands. The ROM 62 is a nonvolatile read only memory. The ROM 62 stores programs for letting the CPU 61 implement various functional units shown in FIG. 3 and execute processes shown in the flow charts of FIGS. 6 through 8. The RAM 63 is a volatile memory for temporarily storing data used by the CPU 61 executing the programs.

The interface unit 66 is a connection unit for electrically connecting the control unit 6 with devices as separate modules directly or indirectly. The data bus 65 is a group of data transmission lines for electrically connecting the CPU 61, the ROM 62, the RAM 63 and the interface unit 66 together. All the data transmission in the control unit 6 is performed through the data bus 65.

Figure 4:
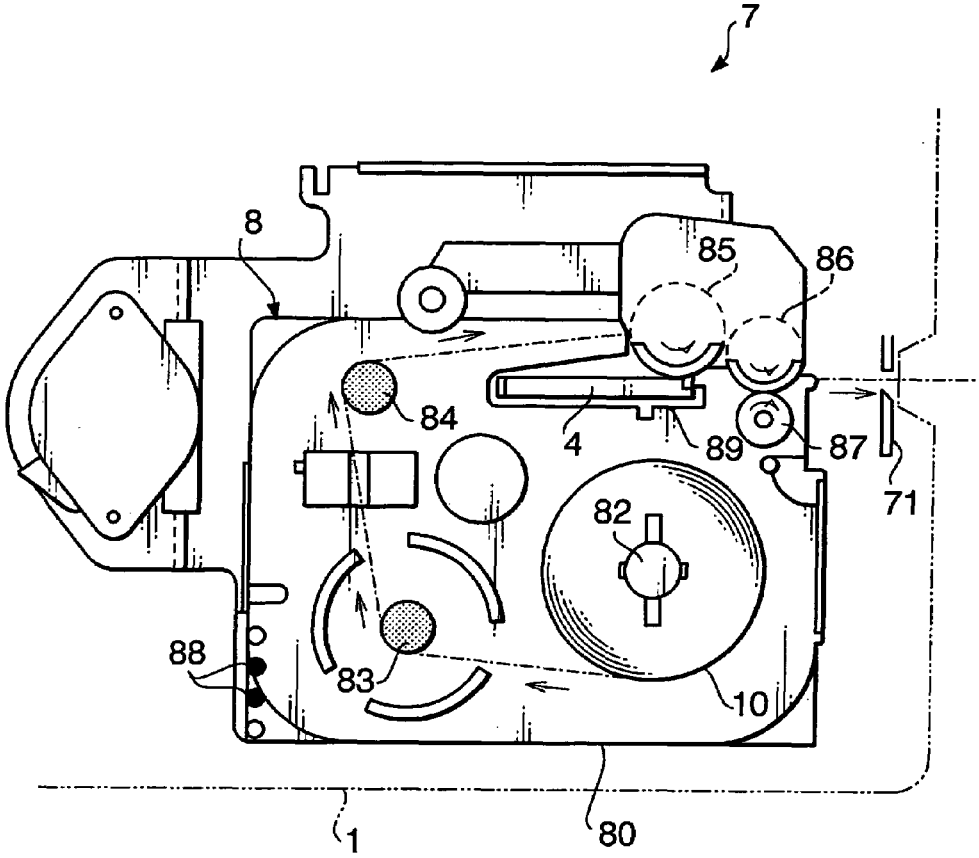
FIG. 4 is a plan view showing a cassette storage part of the tape printing device of FIG. 1.

Next, a print mechanism of the tape printing device 1 will be described referring to FIG. 4. FIG. 4 is an enlarged plan view showing the cassette storage part 7 inside the tape printing device of FIG. 1. The tape cassette 8 is detachably loaded in the cassette storage part 7 of the tape printing device 1. The tape cassette 8 is formed by attaching an unshown upper member on a lower member 80 in a box shape having an open top. Inside the lower member 80, a first spool 82, a second spool 83, a third spool 84, a platen roller 85, a pressure roller 86 and the feed roller 87 are provided.

The feed roller 87 is placed so that a transmission path of rotating/driving force will be formed between the feed roller 87 and the tape feed motor 75 inside the cassette storage part 7 when the tape cassette 8 is loaded in the cassette storage part 7. In the lower member 80, a head accommodating part 89 is formed as a hollow part for accommodating the printing head 4 when the tape cassette 8 is loaded in the cassette storage part 7. When the tape cassette 8 is loaded, the printing head 4 is inserted into the head accommodating part 89 and is placed at a position for making contact with the platen roller 85. The print tape 10 has been rolled up and attached to the first spool 82. As mentioned before, the print tape 10 is available in various types with different tape widths and label area shapes.

The base of the lower member 80 of the tape cassette 8 is provided with two holes 88. In this embodiment, four points on the base of the tape cassette 8 are used for the judgment on the type of tape, and only two points at the middle of the four points are provided with the holes 88. When the tape cassette 8 is attached to the cassette storage part 7, two pins at the middle of four pins of the tape type detector 73 (provided at the bottom of the cassette storage part 7) are inserted into the two holes 88 on the base of the tape cassette 8, while the other two pins on both sides are pressed by the base of the tape cassette 8 against their spring elastic force. The arrangement pattern of holes 88 provided to the tape cassette 8 (i.e. the combination of four points with/without a hole 88) varies depending on the type of the tape. A tape type judgment unit 101 (explained later) judges the type of the loaded tape cassette 8 by detecting whether each pin is pressed or not, thereby judging the type of the loaded print tape 10.

After the loading of the tape cassette 8 in the cassette storage part 7, when an unshown drive motor rotates, the feed roller 87 linked with the drive motor also rotates clockwise as indicated by an arrow in FIG. 4. By the driving force of the rotating feed roller 87, the print tape 10 wound around the first spool 82 of the tape cassette 8 is pulled out and fed in the direction indicated by another arrow in FIG. 4. The print tape 10 pulled out from the first spool 82 is guided by the second spool 83 and the third spool 84 and then pressed against the printing head 4 by the platen roller 85. Meanwhile, the pressure roller 86 presses against the feed roller 87.

While the print tape 10 is fed to be sandwiched between the platen roller 85 and the printing head 4 as above, the heating elements of the printing head 4 are energized selectively and intermittently, by which a desired image is formed on the print tape 10. After the formation of the desired image, the print tape 10 passes between the feed roller 87 and the pressure roller 86 (pressing against each other as above) and is ejected from the tape printing device 1. The ejected print tape 10 is cut off at a proper position by the tape cutter 71 placed in the vicinity of an outlet of the tape printing device 1.

In the case where the print tape 10 is label tape 11, the feeding of the label tape 11 is stopped at a position where one of the position indication marks 15 on the label tape 11 is detected by the position detection sensor 72 placed in the vicinity of the printing head 4. After the label tape 11 is stopped, the tape cutter 71 cuts off the ejected part of the label tape 11.

Next, the configuration of the functional units of the tape printing device 1 will be described referring to FIG. 3. The tape printing device 1 includes the tape type judgment unit (judgment means) 101, a position detection unit (position detection means) 102, a feed cut control unit (feed cut control means) 103 and a feed cut prohibition unit (feed cut prohibition means) 105 which are implemented by the CPU 61, and a character string storage unit 91 which is implemented by the RAM 63.

The character string storage unit 91, configured in the RAM 63, stores character string data (as the object of printing) inputted by the user through the keyboard 3. The character string data is made up of character data of each character. The character data of each character includes a text code (corresponding to font data stored in the ROM 62) and data indicating character decoration, character size, etc.

The tape type judgment unit 101 judges the type of the print tape 10 contained in the tape cassette 8 loaded in the cassette storage part 7. The tape cassette 8 indicates the type of the contained print tape 10 by the arrangement pattern of the holes 88 on the base of the lower member 80. The judgment on the tape type is made by letting the four pins of the tape type detector 73 (provided at the bottom of the cassette storage part 7) recognize the arrangement pattern of the holes 88.

In the case where the print tape 10 is judged as label tape 11 by the tape type judgment unit 101, the position detection unit 102 detects the position indication mark 15 by the position detection sensor 72 and thereby detects the position of each label area 12 of the label tape 11. The detection of the position of each label area 12 is necessary since the printing on the label tape 11 has to be done only on the label areas 12, differently from the printing on normal tape.

The feed cut control unit 103 includes a feeding distance control unit (feeding distance control means) 104. The feed cut control unit 103 lets the feeding distance control unit 104 feed the print tape 10 according to an operation by the user and thereafter lets the tape cutter 71 cut the print tape 10 by driving the cutter drive motor 74.

Figure 5:
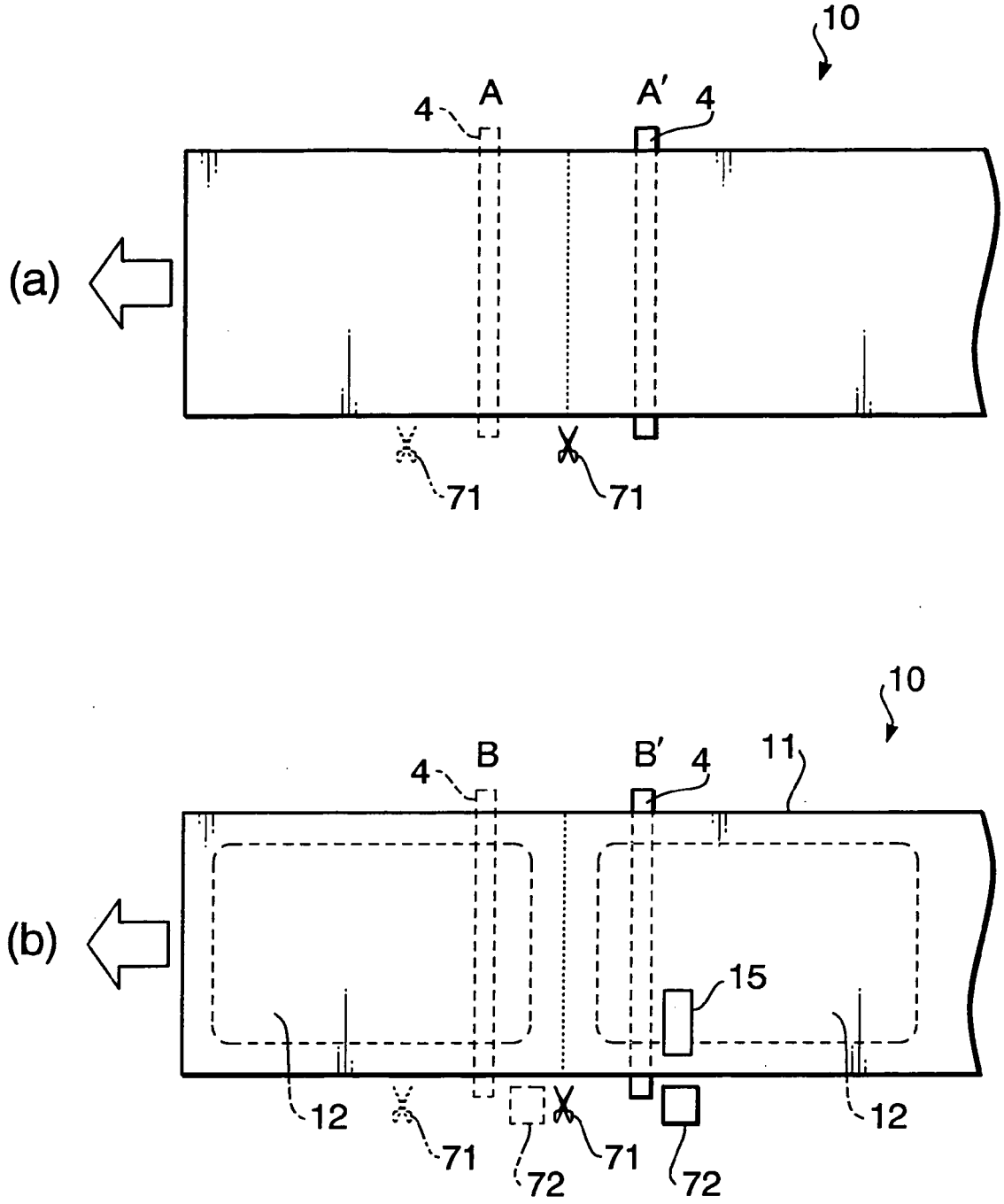
FIG. 5(*a*) and FIG. 5(*b*) are schematic diagrams showing the positional relationship between a printing head and a tape cutter in the tape printing device of FIG. 1.

Here, a "feed" will be explained referring to FIG. 5. FIG. 5 is a schematic diagram showing the positional relationship between the printing head 4 and the tape cutter 71, in which FIG. 5(*a*) shows a case where normal tape is used and FIG. 5(*b*) shows a case where label tape 11 is used. In FIG. 5, each print tape 10 is viewed from its back (strippable sheet) and each arrow indicates the tape feed direction. The dotted straight line on each print tape 10 indicates a cutting line.

The "feed" means to pay out the print tape 10 idly. In the case of FIG. 5(*a*) where normal tape is used, the cutting line of the normal tape has not reached the tape cutter 71 yet at the point of time just after the printing (with the printing head 4 at the position A). Thus, in order to make a label from the printed part of the normal tape, the cutting line of the normal tape has to be fed to the tape cutter 71 (with the printing head 4 at the position A').

Meanwhile, in the case of FIG. 5(*b*) where label tape 11 is used, the cutting line between two label areas 12 of the label tape 11 has not reached the tape cutter 71 yet at the point of time just after the printing (with the printing head 4 at the position B). Thus, in order to perform the printing only on the label areas 12 of the label tape 11, the label tape 11 after the printing is automatically fed so as to let the cutting line reach the tape cutter 71 (with the printing head 4 at the position B'). Therefore, it is generally unnecessary to particularly feed the tape after the printing when label tape 11 is used. However, when the cutting line of the label tape 11 has not reached the tape cutter 71 for some reason, the label tape 11 has to be fed so as to let the cutting line reach the tape cutter 71 (with the printing head 4 at the position B').

Therefore, the user can press the feed & cut key (one of the function keys on the keyboard 3) as needed in order to call up the feed cut control unit 103, by which the print tape 10 is fed as above and cut with the tape cutter 71.

The feeding distance control unit 104, which is called up by the feed cut control unit 103, determines the feeding distance of the print tape 10 based on the type of the print tape 10 contained in the tape cassette 8 loaded in the cassette storage part 7 (judged by the tape type judgment unit 101), and controls the "feed" of the print tape 10 according to the determined feeding distance. In the case where the print tape 10 is judged by the tape type judgment unit 101 as normal tape, the feeding distance control unit 104 sets the feeding distance at a prescribed distance specific to the tape printing device 1 (e.g. 24 mm). Meanwhile, in the case where the print tape 10 is judged by the tape type judgment unit 101 as label tape 11, the feeding distance control unit 104 determines the feeding distance based on the position of the label area 12 detected by the position detection unit 102.

The feed cut prohibition unit 105 is a unit which prohibits the feeding and cutting by the feed cut control unit 103 when the print tape 10 contained in the tape cassette 8 loaded in the cassette storage part 7 has been judged as label tape 11 by the tape type judgment unit 101 and the position of the label area 12 has already been detected by the position detection unit 102.

Figure 6:
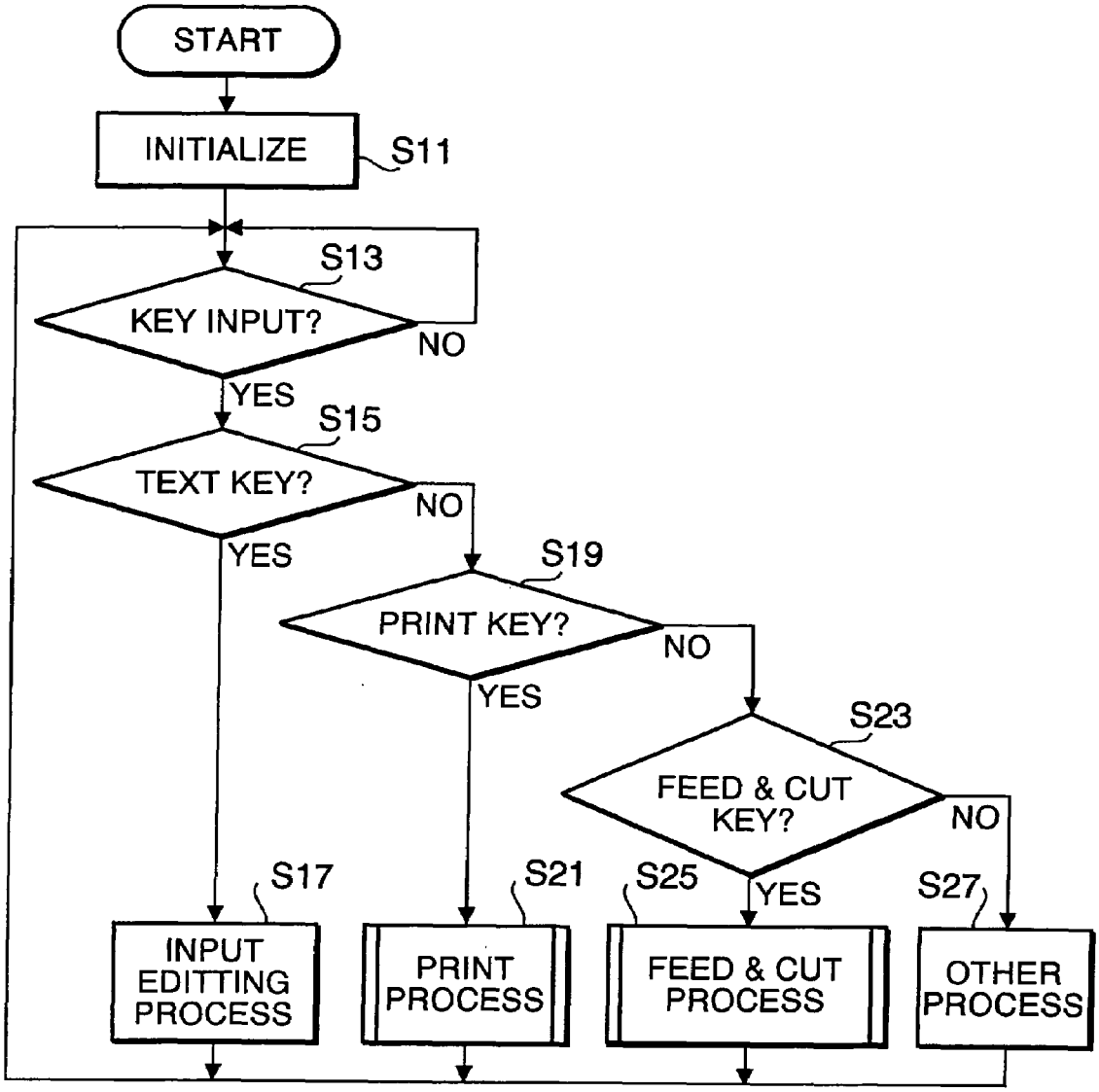
FIG. 6 is a flow chart showing an overall process executed by the tape printing device of FIG. 1.

In the following, processes executed by the tape printing device 1 will be explained with reference to figures. First, an overall process executed by the tape printing device 1 will be described referring to FIG. 6. FIG. 6 is a flow chart showing the overall process of the tape printing device 1.

The control unit starts operating when the power is turned on. In step S11 (hereinafter abbreviated as "S11", ditto for the following steps), the whole tape printing device 1 is initialized. Specifically, the operation check and initialization of the CPU 61, the RAM 63 and the interface 66, the operation check of the display 2 and the printing head 4 connected to the interface 66, and the initialization of hardware are carried out. If no abnormality is found in the operation check and initialization, each functional unit and data stored in the RAM 63 are initialized. After the initialization is finished, an operation screen is displayed on the display 2.

In S13, whether a key input to the keyboard 3 has been made by the user or not is judged. The user can input a character string to be stored in the character string storage unit 91 and operate the tape printing device 1 by making key inputs to the keyboard 3 while seeing the screen displayed on the display 2. The tape printing device 1 after the initialization stays on standby allowing the character string input, and the user can input the character string (as the object of printing) by use of the text keys on the keyboard 3. Even in the input standby state, the user can call up various functions by pressing functions keys such as the print key.

If a key input has been made by the user (S13: YES), a key code corresponding to the key input is stored in a work area of the RAM 63 and thereafter the process advances to S15. If no key input has been made by the user (S13: NO), the process returns to S13 and the CPU 61 waits for a key input by the user.

In S15, whether the key pressed in the key input of S13 is a text key or not is judged based on the key code of the pressed key (stored in the work area of the RAM 63). If the key pressed in S13 is a text key (S15: YES), the process advances to S17 and an input editing process is executed. The input editing process is a process for figuring out a text code corresponding to the key code stored in S13 and storing the text code in the character string storage unit 91 as character data.

After the input editing process is finished, the process returns to S13 and the CPU 61 waits until a key input is made by the user. If the key pressed in S13 is not a text key (S15: NO), the process advances to S19.

In S19, whether the key pressed in S13 is the print key or not is judged. If the pressed key is the print key (S19: YES), the process advances to S21 and a print process (see FIG. 7) is executed as will be explained later. After the print process is finished, the process returns to S13 and the CPU 61 waits until a key input is made by the user. If the key pressed in S13 is not the print key (S19: NO), the process advances to S23.

In S23, whether the key pressed in S13 is the feed & cut key or not is judged. If the pressed key is the feed & cut key (S23: YES), the process advances to S25 and a feed & cut process (see FIG. 8) is executed as will be explained later. After the feed & cut process is finished, the process returns to S13 and the CPU 61 waits until a key input is made by the user. If the key pressed in S13 is not the feed & cut key (S23: NO), the process advances to S27.

In S27, other processes are executed. The "other processes" include processes corresponding to other function keys, processes corresponding to the cursor keys, etc. When the "other processes" are finished, the process returns to S13 and the CPU 61 waits until a key input is made by the user. The control system is turned off when a power switch of the tape printing device 1 is turned "OFF".

Figure 7:
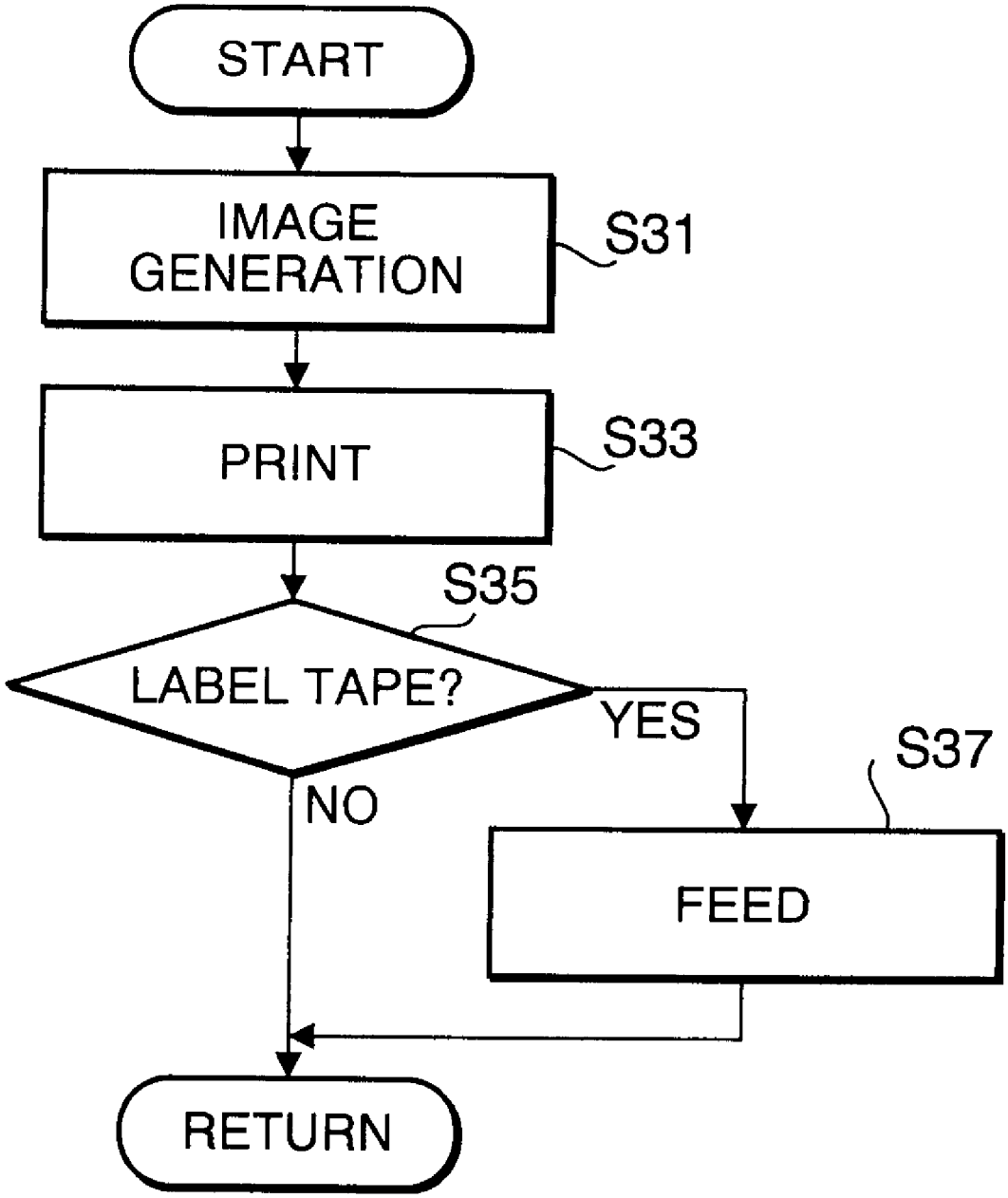
FIG. 7 is a flow chart showing the procedure of a print process executed by the tape printing device of FIG. 1.

Next, the print process of S21 of the flow chart of FIG. 6 will be explained referring to FIG. 7. FIG. 7 is a flow chart showing the procedure of the print process.

First, a print image is generated in S31. The generation of a print image means a process for developing memory contents of the character string storage unit 91 into dot pattern data (according to actual printing status) in a work area of the RAM 63, based on the character data stored in the character string storage unit 91, character size and font shape which have been set, the presence/absence of character decoration (bold face, oblique face, etc.) and the presence/absence of line decoration (frames, etc.)

Subsequently, in S33, the printing on the print tape 10 is executed according to the print image generated in S31. Data is sent to the printing head 4 according to the generated print image, and a desired character string image is formed on the print tape 10 by the heating elements of the printing head 4. Subsequently, the process advances to S35 and whether the type of the print tape 10 contained in the tape cassette 8 loaded in the cassette storage part 7 is label tape 11 or not is judged by the tape type judgment unit 101. If the type of the print tape 10 is not label tape 11 (S35: NO), the flow chart of FIG. 7 is ended. Thereafter, the process returns to S13 of the flow chart of FIG. 6 and the CPU 61 waits until a key input is made by the user.

If the type of the print tape 10 is label tape 11 (S35: YES), the process advances to S37. In S37, the label tape 11 is fed until the position of a label area 12 of the label tape 11 is detected by the position detection unit 102, and the flow chart of FIG. 7 is ended. Thereafter, the process returns to S13 of the flow chart of FIG. 6 and the CPU 61 waits until a key input is made by the user.

Figure 8:
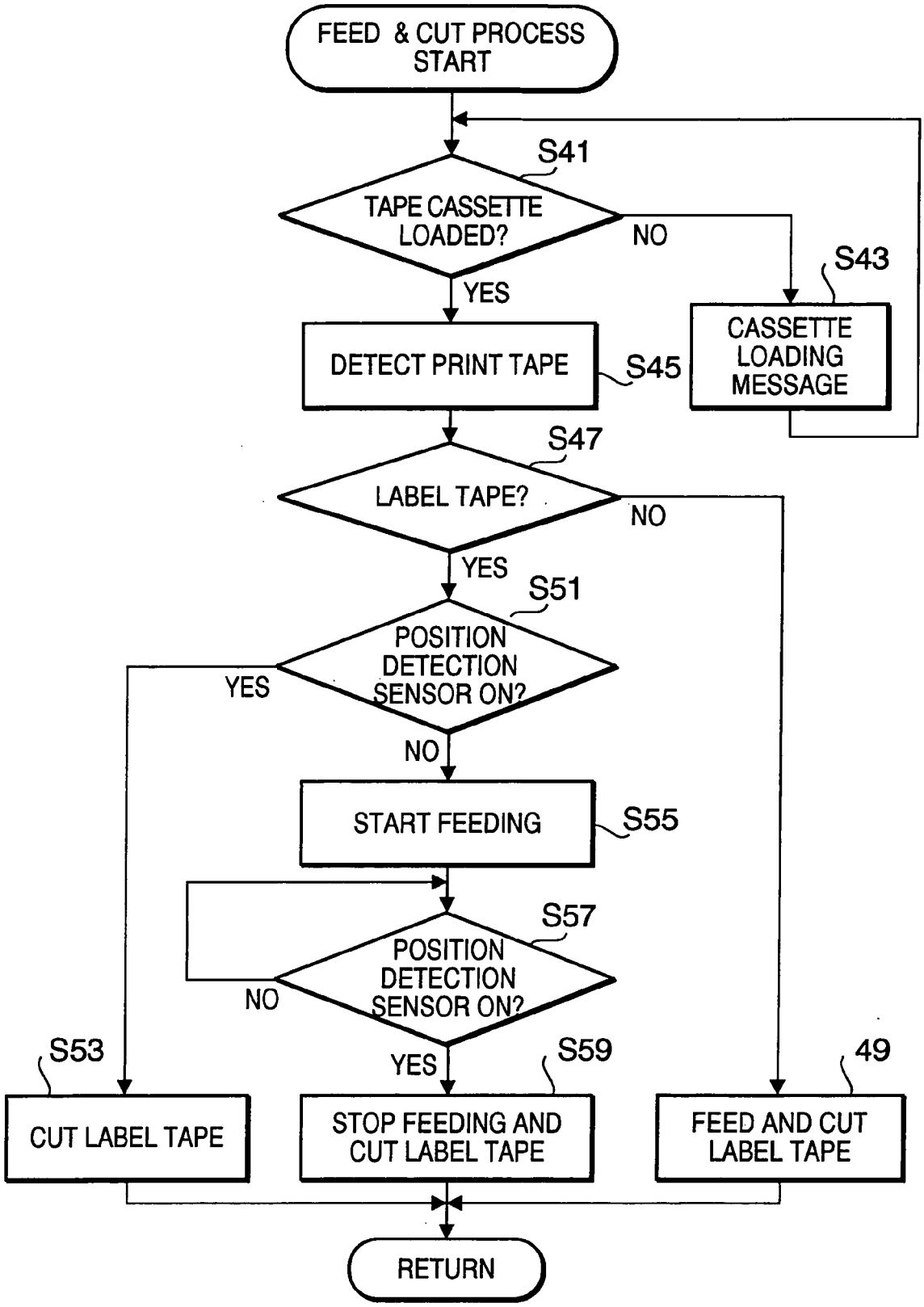
FIG. 8 is a flow chart showing the procedure of a feed & cut process executed by the tape printing device of FIG. 1.

Next, the feed & cut process of S25 of the flow chart of FIG. 6 will be explained referring to FIG. 8. FIG. 8 is a flow chart showing the procedure of the feed & cut process.

First, whether a tape cassette 8 has been loaded in the cassette storage part 7 or not is judged by the tape type judgment unit 101 in S41. If no tape cassette 8 is judged to be in the cassette storage part 7 (S41: NO), the process advances to S43 and a message requesting the loading of a tape cassette 8 into the cassette storage part 7 is displayed on the display 2. Thereafter, the process returns to S41 and the loop is repeated until a tape cassette 8 is loaded in the cassette storage part 7.

If a tape cassette 8 has been loaded in the cassette storage part 7 (S41: YES), the process advances to S45, in which the type of the print tape 10 contained in the tape cassette 8 loaded in the cassette storage part 7 is detected by the tape type judgment unit 103.

In the next S47, whether the type of the print tape 10 detected in S45 is label tape 11 or not is judged. If the detected type of the print tape 10 is not label tape 11 (S47: NO), the process advances to S49, in which the print tape 10 is fed a prescribed distance by the feed cut control unit 103 and is cut by the tape cutter 71. Thereafter, the flow chart of FIG. 8 is ended, the process returns to S13 of the flow chart of FIG. 6, and the CPU 61 waits until a key input is made by the user.

If the detected type of the print tape 10 is label tape 11 (S47: YES), the process advances to S51 and whether the position of a label area of the label tape 11 has already been detected by the position detection unit 102 or not is judged. If the position of a label area 12 has already been detected (S51: YES), the process advances to S53. In S53, the feeding and cutting of the label tape 11 by the feed cut control unit 103 are prohibited by the feed cut prohibition unit 105; however, the label tape 11 is cut by the tape cutter 71 since part of the label tape 11 after being printed on has to be cut off. Thereafter, the flow chart of FIG. 8 is ended, the process returns to S13 of the flow chart of FIG. 6, and the CPU 61 waits until a key input is made by the user.

If the position of a label area 12 has not been detected yet (S51: NO), the process advances to S55 and the feed of the label tape 11 is started. In the next S57, whether a position indication mark 15 is detected by the position detection sensor 72 or not is judged. If no position indication mark 15 is detected (S57: NO), the process returns to S57 and the step is repeated until a position indication mark 15 is detected. When a position indication mark 15 is detected (S57: YES), the process advances to S59, in which the position of a label area 12 is detected based on the detected position of the position indication mark 15 and thereafter the label tape 11 is cut by the tape cutter 71. Thereafter, the flow chart of FIG. 8 is ended, the process returns to S13 of the flow chart of FIG. 6, and the CPU 61 waits until a key input is made by the user.

As described above, by this embodiment, even when label tape 11 is used, the user can make the tape printing device 1 execute the feeding and cutting of the label tape 11 by performing the same operation as that for normal tapes. Therefore, the tape printing device 1 of the embodiment causes no confusion to the user.

When label tape 11 is used, the label tape 11 is fed so as to let the tape cutter 71 be positioned in a non-label area between two label areas 12 based on the position indication mark 15 of the label tape 11, by which each label area 12 is prevented from being segmented and wastage of the label tape 11 can be avoided.

Further, in the case where label tape 11 is used, the feed of the label tape 11 by the feed cut control unit 104 is prohibited when a position indication mark, as a reference point of the position of each label area 12 of the label tape 11, has already been detected by the position detection unit 102, by which the wastage of the label tape can be avoided.

While a description has been given above of a preferred embodiment in accordance with the present invention, the present invention is not to be restricted by the particular illustrative embodiment and a variety of modifications, design changes, etc. are possible without departing from the scope and spirit of the present invention described in the appended claims. For example, while the tape printing device of the above embodiment is configured to let the feed cut control unit 103 feed the print tape 10 and cut the print tape 10 with the tape cutter 71, the tape printing device may also be configured to let the feed cut control unit execute the feeding of the print tape 10 only, without cutting the print tape 10 with the tape cutter 71. The tape printing device may also be configured to let the user select whether to let the tape cutter 71 cut the print tape 10 or not after the feeding of the print tape 10.

While the feeding distance control unit 104 determines the feeding distance of label tape 11 based on the position of the position indication mark 15 detected by the position detection unit 102 in the above embodiment, the tape printing device may also be configured without the position detection unit 102, to determine the feeding distance of label tape 11 in the same way as the feeding distance of normal tape, or to determine the feeding distance according to an instruction by the user.

While the operation of the feed cut control unit 103 is prohibited when the position of a position indication mark 15 of label tape 11 has already been detected by the position detection unit 102 in the above embodiment, the tape printing device may also be configured to perform the operation of feeding the label tape 11 with the feed cut control unit 103 and cutting the label tape 11 with the tape cutter 71 in all cases.

While the tape printing device is configured as a stand-alone device in the above embodiment, part or all of the control unit of the tape printing device may also be implemented by a program functioning on a personal computer connected to the tape printing device. Or part or all of the control unit of the tape printing device may also be installed in a device other than a personal computer.

In an embodiment of the present invention, the tape printing device may further comprise position detection means for detecting position indication marks provided on the label tape corresponding to the arrangement of the label areas on the label tape, and the feeding distance control means may control the feeding distance of the label tape so that a cutting position of the print medium after the printing will be situated in a non-label area between adjacent label areas based on a detection signal of the position detection means.

By the above configuration, when label tape is used, the label tape is fed so as to let the cutting position be situated in a non-label area between label areas based on the position indication mark of the label tape, by which each label area is prevented from being segmented and wastage of the label tape can be avoided.

In an embodiment of the present invention, the tape printing device may further comprise feed cut prohibition means for prohibiting the feed cut operation by the feed cut control means based on a detection signal generated by the position detection means.

By the above configuration, the feed cut operation is prohibited when the position indication mark of a label area of the label tape has already been detected, by which wastage of the label tape can be avoided.

In an embodiment of the present invention, the tape printing device may further comprise position detection means for detecting position indication marks provided on the label tape corresponding to the arrangement of the label areas on the label tape, and the feeding distance control means may control the feeding distance of the label tape so that a cutting position of the print medium after the printing will be situated in a non-label area between adjacent label areas based on a detection signal of the position detection means.

By the above configuration, when label tape is used, the label tape is fed so as to let the cutting position be situated in a non-label area between label areas based on the position indication mark of the label tape, by which each label area is prevented from being segmented and wastage of the label tape can be avoided.

In an embodiment of the present invention, the tape printing device may further comprise feed prohibition means for prohibiting the feed operation by the feed control means based on a detection signal generated by the position detection means.

By the above configuration, the feed operation is prohibited when the position indication mark of a label area of the label tape has already been detected, by which wastage of the label tape can be avoided.

In an embodiment of the present invention, the program may further let the computer function as position detection means for detecting position indication marks provided on the label tape corresponding to the arrangement of the label areas on the label tape, and the feeding distance control means may control the feeding distance of the label tape so that a cutting position of the print medium after the printing will be situated in a non-label area between adjacent label areas based on a detection signal of the position detection means.

By the above configuration, when label tape is used, the label tape is fed so as to let the cutting position be situated in a non-label area between label areas based on the position indication mark of the label tape, by which each label area is prevented from being segmented and wastage of the label tape can be avoided.

In an embodiment of the present invention, the program may further let the computer function as feed cut prohibition means for prohibiting the feed cut operation by the feed cut control means based on a detection signal generated by the position detection means.

By the above configuration, the feed cut operation is prohibited when the position indication mark of a label area of the label tape has already been detected, by which wastage of the label tape can be avoided.

In an embodiment of the present invention, the program may further let the computer function as position detection means for detecting position indication marks provided on the label tape corresponding to the arrangement of the label areas on the label tape, and the feeding distance control means may control the feeding distance of the label tape so that a cutting position of the print medium after the printing will be situated in a non-label area between adjacent label areas based on a detection signal of the position detection means.

By the above configuration, when label tape is used, the label tape is fed so as to let the cutting position be situated in a non-label area between label areas based on the position indication mark of the label tape, by which each label area is prevented from being segmented and wastage of the label tape can be avoided.

In an embodiment of the present invention, the program may further let the computer function as feed prohibition means for prohibiting the feed operation by the feed control means based on a detection signal generated by the position detection means.

By the above configuration, the feed operation is prohibited when the position indication mark of a label area of the label tape has already been detected, by which wastage of the label tape can be avoided.

The programs described above can be delivered by storing them in a removable record medium (CD-ROM, FD, MO, etc.) or a fixed record medium (hard disk, etc.), or via a communication network (e.g. the Internet) by use of a wired or wireless telecommunication means.

In an embodiment of the present invention, the control means may execute the control so as to cut the print medium after the feed operation.

In an embodiment of the present invention, the control means may perform the feed operation when a prescribed key is manipulated.

In an embodiment of the present invention, the printing operation control method may further comprise the step of detecting position indication marks provided on the label tape corresponding to the arrangement of the label areas on the label tape, and the feeding distance control step may control the feeding distance of the label tape so that a cutting position of the print medium after the printing will be situated in a non-label area between adjacent label areas based on a detection signal generated in the position indication mark detection step.

In an embodiment of the present invention, the printing operation control method may further comprise the step of prohibiting the feed cut operation in the control of the feeding distance based on a detection signal generated in the position indication mark detection step.

Incidentally, the control of the feeding distance of the tape can be realized by, for example, letting the feeding distance control means (the feeding distance control unit 104 in the above embodiment) control a driving amount of a motor (the tape feed motor 75 in the above embodiment). Specifically, the motor driving amount can be controlled in terms of the number of steps when a stepping motor is employed. For a DC motor, the driving amount can be controlled by controlling driving time. The driving amount of a DC motor can also be controlled by used of an encoder.

The above printing operation control methods as embodiments of the present invention achieve the same effects as the tape printing devices and the programs described above.

What is claimed is:

1. A tape printing device capable of using label tape having a plurality of label areas as targets of printing arranged on a long support tape along the length of the support tape and normal tape allowing printing at any position on a long tape-like image receiving medium, comprising:

a judgment unit that judges whether the print medium currently used is label tape or normal tape, without contacting the print medium, based on the state of at least one selectively blocked member, the selectively blocked member being selectively blocked by the configuration of holes in a cassette;

a feed cut controller that performs a feed cut operation of feeding the print medium and thereafter cutting the print medium; and a feed cut prohibition unit that selectively prohibits the feed cut operation by the feed cut controller;

wherein the feed cut controller includes a feeding distance controller that controls feeding distance before the cutting in the feed cut operation depending on the judgment by the judgment unit.

2. The tape printing device according to claim 1, further comprising a position detection unit that detects position indication marks provided on the label tape corresponding to the arrangement of the label areas on the label tape;

wherein the feeding distance controller controls the feeding distance of the label tape so that a cutting position of the print medium after the printing will be situated in a non-label area between adjacent label areas based on a detection signal of the position detection unit.

3. The tape printing device according to claim 2, the feed cut prohibition unit selectively prohibiting the feed cut operation by the feed cut controller based on a detection signal generated by the position detection unit.

4. A tape printing device capable of using label tape having a plurality of label areas as targets of printing arranged on a long support tape along the length of the support tape and normal tape allowing printing at any position on a long tape-like image receiving medium, comprising:

a judgment unit that judges whether the print medium currently used is label tape or normal tape, without contacting the print medium, based on the state of at least one selectively blocked member, the selectively blocked member being selectively blocked by the configuration of holes in a cassette;

a feed controller that performs a feed operation of feeding the print medium; and a feed prohibition unit that selectively prohibits the feed operation by the feed controller;

wherein the feed controller includes a feeding distance controller that controls feeding distance in the feed operation depending on the judgment by the judgment unit.

5. The tape printing device according to claim 4, further comprising a position detection unit that detects position indication marks provided on the label tape corresponding to the arrangement of the label areas on the label tape;

wherein the feeding distance controller controls the feeding distance of the label tape so that a cutting position of the print medium after the printing will be situated in a non-label area between adjacent label areas based on a detection signal of the position detection unit.

6. The tape printing device according to claim 5, the feed prohibition unit selectively prohibiting the feed operation by the feed controller based on a detection signal generated by the position detection unit.

7. A computer executable program stored on a computer readable medium located in a tape printing device, the tape printing device capable of using label tape having a plurality of label areas as targets of printing arranged on a long support tape along the length of the support tape and normal tape allowing printing at any position on a long tape-like image receiving medium, the computer executable program comprising computer-readable instructions that cause the tape printing device to function as:

a judgment unit that judges whether the print medium currently used is label tape or normal tape, without contacting the print medium, based on the state of at least one selectively blocked member, the selectively blocked member being selectively blocked by the configuration of holes in a cassette;

a feed cut controller that performs a feed cut operation of feeding the print medium and thereafter cutting the print medium; and a feed cut prohibition unit that selectively prohibits the feed cut operation by the feed cut controller;

wherein the feed cut controller includes a feeding distance controller that controls feeding distance before the cutting in the feed cut operation depending on the judgment by the judgment unit.

8. The computer executable program stored on a computer readable medium according to claim 7, further comprising computer-readable instructions that cause the tape printing device to function as a position detection unit that detects position indication marks provided on the label tape corresponding to the arrangement of the label areas on the label tape;

wherein the feeding distance controller controls the feeding distance of the label tape so that a cutting position of the print medium after the printing will be situated in a non-label area between adjacent label areas based on a detection signal of the position detection unit.

9. The computer executable program stored on a computer readable medium according to claim 8 causing the tape printing device to function as the feed cut prohibition unit selectively prohibiting the feed cut operation by the feed cut controller based on a detection signal generated by the position detection unit.

10. A computer executable program stored on a computer readable medium located in a tape printing device, the tape printing device capable of using label tape having a plurality of label areas as targets of printing arranged on a long support tape along the length of the support tape and normal tape allowing printing at any position on a long tape-like image receiving medium, the computer executable program comprising computer-readable instructions that cause the tape printing device to function as:

a judgment unit that judges whether the print medium currently used is label tape or normal tape, without contacting the print medium, based on the state of at least one selectively blocked member, the selectively blocked member being selectively blocked by the configuration of holes in a cassette;

a feed controller that performs a feed operation of feeding the print medium; and a feed prohibition unit that selectively prohibits the feed operation by the feed controller;

wherein the feed controller includes a feeding distance controller that controls feeding distance in the feed operation depending on the judgment by the judgment unit.

11. The computer executable program stored on a computer readable medium according to claim 10, further comprising computer-readable instructions that cause the tape printing device to function as a position detection unit that detects position indication marks provided on the label tape corresponding to the arrangement of the label areas on the label tape;

wherein the feeding distance controller controls the feeding distance of the label tape so that a cutting position of the print medium after the printing will be situated in a non-label area between adjacent label areas based on a detection signal of the position detection unit.

12. The computer executable program stored on a computer readable medium according to claim 11, causing the tape printing device to function as the feed prohibition unit selectively prohibiting the feed operation by the feed controller based on a detection signal generated by the position detection unit.

13. A tape printing device capable of using label tape having a plurality of label areas as targets of printing arranged on a long support tape along the length of the support tape and normal tape allowing printing at any position on a long tape-like image receiving medium, comprising:

a judgment unit that judges whether the print medium currently used is label tape or normal tape, without contacting the print medium, based on the state of at least one selectively blocked member, the selectively blocked member being selectively blocked by the configuration of holes in a cassette; and a controller which executes control so as to perform a feed operation to the print medium differently depending on the judgment by the judgment unit and selectively prohibits the feed operation.

14. The tape printing device according to claim 13, wherein the controller executes the control so as to cut the print medium after the feed operation.

15. The tape printing device according to claim 13, wherein the controller performs the feed operation when a prescribed key is manipulated.

16. A printing operation control method for a tape printing device capable of using label tape having a plurality of label areas as targets of printing arranged on a long support tape along the length of the support tape and normal tape allowing printing at any position on a long tape-like image receiving medium, comprising the steps of:

judging whether the print medium currently used is label tape or normal tape, without contacting the print medium, based on the state of at least one selectively blocked member, the selectively blocked member being selectively blocked by the configuration of holes in a cassette;

controlling feeding distance before cutting in a feed cut operation of feeding the print medium and thereafter cutting the print medium, depending on the judgment by the judging step; and prohibiting, selectively, the feed cut operation in the control of the feeding distance.

17. The printing operation control method according to claim 16, further comprising the step of detecting position indication marks provided on the label tape corresponding to the arrangement of the label areas on the label tape;

wherein the feeding distance control step controls the feeding distance of the label tape so that a cutting position of the print medium after the printing will be situated in a non-label area between adjacent label areas based on a detection signal generated in the position indication mark detection step.

18. The printing operation control method according to claim 17, wherein selectively prohibiting the feed cut operation in the control of the feeding distance is based on a detection signal generated in the position indication mark detection step.

19. A printing operation control method for a tape printing device capable of using label tape having a plurality of label areas as targets of printing arranged on a long support tape along the length of the support tape and normal tape allowing printing at any position on a long tape-like image receiving medium, comprising the steps of:

judging whether the print medium currently used is label tape or normal tape, without contacting the print medium, based on the state of at least one selectively blocked member, the selectively blocked member being selectively blocked by the configuration of holes in a cassette;

controlling feeding distance in a feed operation of feeding the print medium, depending on the judgment by the judging step; and prohibiting, selectively, the feed operation in the control of the feeding distance.

20. The printing operation control method according to claim 19, further comprising the step of detecting position indication marks provided on the label tape corresponding to the arrangement of the label areas on the label tape;

wherein the feeding distance control step controls the feeding distance of the label tape so that a cutting position of the print medium after the printing will be situated in a non-label area between adjacent label areas based on a detection signal generated in the position indication mark detection step.

21. The printing operation control method according to claim 20, wherein selectively prohibiting the feed operation in the control of the feeding distance is based on a detection signal generated in the position indication mark detection step.

* * * * *